US010756496B2

(12) United States Patent
Youtsey

(10) Patent No.: US 10,756,496 B2
(45) Date of Patent: Aug. 25, 2020

(54) CONNECTOR WITH RESPONSIVE INNER DIAMETER

(71) Applicant: PCT International, Inc., Mesa, AZ (US)

(72) Inventor: Timothy L. Youtsey, Tempe, AZ (US)

(73) Assignee: PCT International, Inc., Mesa, AZ (US)

( * ) Notice: Subject to any disclaimer, the term of this patent is extended or adjusted under 35 U.S.C. 154(b) by 0 days.

(21) Appl. No.: 16/427,348

(22) Filed: May 31, 2019

(65) Prior Publication Data

US 2019/0372280 A1 Dec. 5, 2019

Related U.S. Application Data

(60) Provisional application No. 62/679,756, filed on Jun. 1, 2018.

(51) Int. Cl.

| | |
|---|---|
| ***H01R 13/502*** | (2006.01) |
| ***H01R 24/40*** | (2011.01) |
| *H01R 103/00* | (2006.01) |
| *H01R 9/05* | (2006.01) |
| *H01R 13/58* | (2006.01) |

(52) U.S. Cl.

CPC ..... *H01R 24/40* (2013.01); *H01R 13/5025* (2013.01); *H01R 9/0527* (2013.01); *H01R 13/5816* (2013.01); *H01R 13/5825* (2013.01); *H01R 2103/00* (2013.01)

(58) Field of Classification Search

CPC ..... H01R 9/0527; H01R 13/5816; H01R 13/5825

See application file for complete search history.

(56) References Cited

U.S. PATENT DOCUMENTS

| | | | |
|---|---|---|---|
| 2,367,175 | A | 1/1945 | Hahn |
| 2,754,487 | A | 7/1956 | Carr et al. |
| 3,199,061 | A | 8/1965 | Johnson et al. |
| 4,377,320 | A | 3/1983 | Lathrop et al. |
| 4,629,272 | A | 12/1986 | Mattingly et al. |
| 4,990,104 | A | 2/1991 | Schieferly |
| 4,990,106 | A | 2/1991 | Szegda |
| 5,466,173 | A | 11/1995 | Down |
| 5,498,175 | A | 3/1996 | Yeh et al. |
| 5,501,616 | A | 3/1996 | Holliday |
| 5,879,191 | A | 3/1999 | Burris |
| 5,975,951 | A | 11/1999 | Burris et al. |
| 5,993,254 | A | 11/1999 | Pitschi et al. |

(Continued)

*Primary Examiner* — Tho D Ta

(74) *Attorney, Agent, or Firm* — Thomas W. Galvani, P.C.; Thomas W. Galvani

(57) ABSTRACT

A coaxial cable connector includes an outer barrel having a front end and a rear end. The connector includes an inner sleeve within the outer barrel defining a bore, the inner sleeve moving between uncompressed and compressed conditions and including a finger which is formed in the inner sleeve for resilient movement between a neutral position in which the finger is out of the bore, and a deformed position in which the finger is deformed into the bore. The finger includes a base formed to the inner sleeve and a free end. Axial movement of the inner sleeve with respect to the outer barrel from a compressed condition to an uncompressed condition imparts movement to the finger from the neutral position to the deformed position.

19 Claims, 6 Drawing Sheets

(56) References Cited

U.S. PATENT DOCUMENTS 5,997,350 A 12/1999 Burris et al.
6,010,289 A 1/2000 Distasio et al.
6,042,422 A 3/2000 Youtsey
6,089,912 A 7/2000 Tallis et al.
6,153,830 A 11/2000 Montena
6,217,383 B1 4/2001 Holland et al.
6,425,782 B1 7/2002 Holland
6,648,683 B2 11/2003 Youtsey
6,712,631 B1 3/2004 Youtsey
6,729,912 B2 5/2004 DAddario
6,767,248 B1 7/2004 Hung
6,848,939 B2 2/2005 Stirling
7,008,263 B2 3/2006 Holland
7,018,235 B1 3/2006 Burris et al.
7,021,965 B1 4/2006 Montena et al.
7,063,565 B2 6/2006 Ward
7,125,283 B1 10/2006 Lin
7,128,603 B2 10/2006 Burris et al.
7,144,272 B1 12/2006 Burris et al.
7,182,639 B2 2/2007 Burris
7,252,546 B1 8/2007 Holland
7,288,002 B2 10/2007 Rodrigues et al.
7,300,309 B2 11/2007 Montena
7,354,307 B2 4/2008 Chee et al.
7,364,462 B2 4/2008 Holland
7,377,809 B2 5/2008 Dyck
7,387,531 B2 6/2008 Cook
7,395,166 B2 7/2008 Plishner
7,404,373 B2 7/2008 Bailey
7,404,737 B1 7/2008 Youtsey
7,410,389 B2 8/2008 Holliday
7,455,550 B1 * 11/2008 Sykes ..... H01R 13/506 439/578
7,458,851 B2 12/2008 Montena et al.
7,510,432 B2 3/2009 Entsfellner
7,527,524 B1 5/2009 Coleman et al.
7,568,944 B1 8/2009 Linan
7,588,460 B2 9/2009 Malloy et al.
7,753,727 B1 7/2010 Islam et al.
7,845,978 B1 12/2010 Chen
7,857,661 B1 12/2010 Islam
7,934,953 B1 5/2011 Solis
7,955,088 B2 6/2011 Di Stefano
7,976,339 B2 7/2011 Buck et al.
7,997,930 B2 8/2011 Ehret et al.
8,029,316 B2 10/2011 Snyder et al.
8,038,471 B2 10/2011 Malak
8,075,339 B2 12/2011 Holliday
8,118,612 B2 2/2012 Morikawa
8,137,132 B2 3/2012 Lu
8,167,635 B1 5/2012 Mathews
8,272,893 B2 9/2012 Burris et al.
8,287,320 B2 10/2012 Purdy et al.
8,337,229 B2 12/2012 Montena
8,348,697 B2 1/2013 Zraik
8,366,481 B2 2/2013 Ehret et al.
8,444,433 B2 5/2013 Snyder et al.
8,469,739 B2 6/2013 Rodrigues et al.
8,491,334 B2 7/2013 Rodrigues
8,556,656 B2 * 10/2013 Thomas ..... H01R 9/0521 439/584
8,568,164 B2 10/2013 Ehret et al.
8,579,658 B2 11/2013 Youtsey
8,632,360 B2 1/2014 Tremba et al.
8,657,626 B2 2/2014 Duval et al.
8,690,603 B2 4/2014 Bence et al.
8,753,147 B2 6/2014 Montena
8,801,448 B2 8/2014 Purdy et al.
8,834,200 B2 9/2014 Shaw
8,840,429 B2 9/2014 Thomas et al.
8,888,526 B2 11/2014 Burris
8,894,440 B2 11/2014 Rodrigues et al.
8,915,751 B2 12/2014 Wood
8,944,846 B2 2/2015 Lee
9,039,446 B2 5/2015 Youtsey
9,040,822 B2 5/2015 Nieto
9,048,599 B2 6/2015 Burris
9,071,019 B2 6/2015 Burris et al.
9,083,113 B2 7/2015 Wild et al.
9,088,078 B2 7/2015 Youtsey
9,172,157 B2 10/2015 Burris
9,257,780 B2 2/2016 Thomas et al.
9,300,094 B2 3/2016 Youtsey
2002/0164900 A1 11/2002 Youtsey
2004/0048514 A1 3/2004 Kodaira
2005/0148236 A1 7/2005 Montena
2007/0020973 A1 1/2007 Sattele et al.
2007/0049113 A1 3/2007 Rodrigues et al.
2009/0053928 A9 2/2009 Entsfellner
2010/0261380 A1 10/2010 Skeels et al.
2010/0297875 A1 11/2010 Purdy et al.
2011/0143586 A1 6/2011 Ehret et al.
2012/0021642 A1 1/2012 Zraik
2012/0270439 A1 10/2012 Tremba et al.
2012/0329311 A1 12/2012 Duval et al.
2013/0059468 A1 * 3/2013 Wood ..... H01R 9/05 439/584
2013/0072059 A1 3/2013 Purdy et al.
2013/0330967 A1 12/2013 Youtsey
2013/0337683 A1 12/2013 Chastain et al.
2014/0242837 A1 8/2014 Youtsey
2014/0248798 A1 9/2014 Youtsey
2014/0342594 A1 11/2014 Montena
2015/0050825 A1 2/2015 Krenceski et al.
2015/0118901 A1 4/2015 Burris
2015/0162675 A1 6/2015 Davidson, Jr. et al.
2015/0180141 A1 6/2015 Wei
2017/0104280 A1 4/2017 Edmonds et al.
2018/0131139 A1 5/2018 Matzen et al.

* cited by examiner

CONNECTOR WITH RESPONSIVE INNER DIAMETER

CROSS-REFERENCE TO RELATED APPLICATIONS

This application claims the benefit of U.S. Provisional Application No. 62/679,756, filed Jun. 1, 2018, which is hereby incorporated by reference.

FIELD OF THE INVENTION

The present invention relates generally to electrical apparatus, and more particularly to coaxial cable connectors.

BACKGROUND OF THE INVENTION

Coaxial cables transmit radio frequency ("RF") signals between transmitters and receivers and are used to interconnect televisions, cable boxes, DVD players, satellite receivers, modems, and other electrical devices and electronic components. Typical coaxial cables include an inner conductor surrounded by a flexible dielectric insulator, a foil layer, a conductive metallic tubular sheath or shield, and a polyvinyl chloride jacket. The RF signal is transmitted through the inner conductor. The conductive tubular shield provides a ground and inhibits electrical and magnetic interference with the RF signal in the inner conductor.

Coaxial cables must be terminated with cable connectors to be coupled to mating posts of electrical devices. Connectors typically have a connector body, a threaded fitting mounted for rotation on an end of the connector body, a bore extending into the connector body from an opposed end to receive the coaxial cable, and an inner post within the bore coupled in electrical communication with the fitting. Generally, connectors are crimped onto a prepared end of a coaxial cable to secure the connector to the coaxial cable. Crimping usually requires a special tool.

Connectors must perform in a number of ways despite operating and environmental conditions. Connectors must maintain electrical connection and signal shielding with the cable despite rotation, tugging, bending, or other movement of the cable and the connector. Connectors must stay secured on cables over time; cyclical temperature changes and wind loads alone can cause a cable and its connector to come loose. Connectors must also mitigate the introduction of interference or ingress noise into the connector and signal pathway. Without properly seating and securing a connector on a female connector or post, ingress noise can leak into the connector, or the connector can fail to deliver a consistent signal, or the cable can even fall out of the connector. Not all consumers have installation tools, and yet most tool-less connectors are susceptible to the above problems. An improved connector is needed.

SUMMARY OF THE INVENTION

A coaxial cable connector includes an outer barrel having a front end and a rear end. The connector includes an inner sleeve within the outer barrel defining a bore, the inner sleeve moving between uncompressed and compressed conditions and including a finger which is formed in the inner sleeve for resilient movement between a neutral position in which the finger is out of the bore, and a deformed position in which the finger is deformed into the bore. The finger includes a base formed to the inner sleeve and a free end. Axial movement of the inner sleeve with respect to the outer barrel from a compressed condition to an uncompressed condition imparts movement to the finger from the neutral position to the deformed position.

The above provides the reader with a very brief summary of some embodiments discussed below. Simplifications and omissions are made, and the summary is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figure 1A:
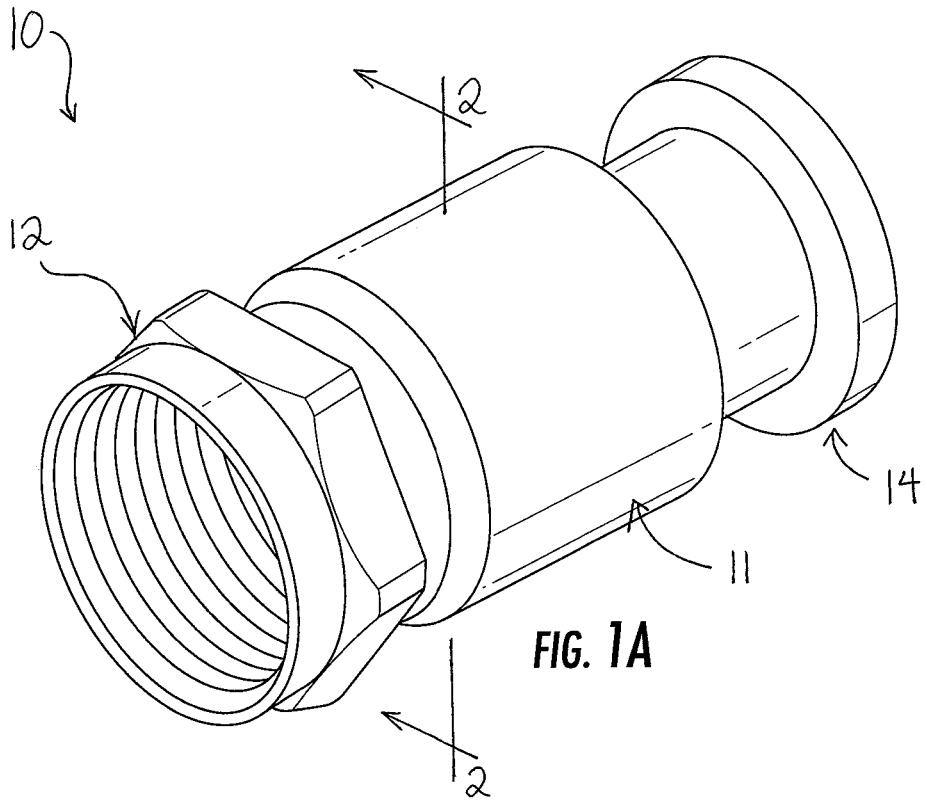
FIGS. 1A and 1B are perspective and exploded perspective views, respectively, of a coaxial cable connector.
Figure 1B:
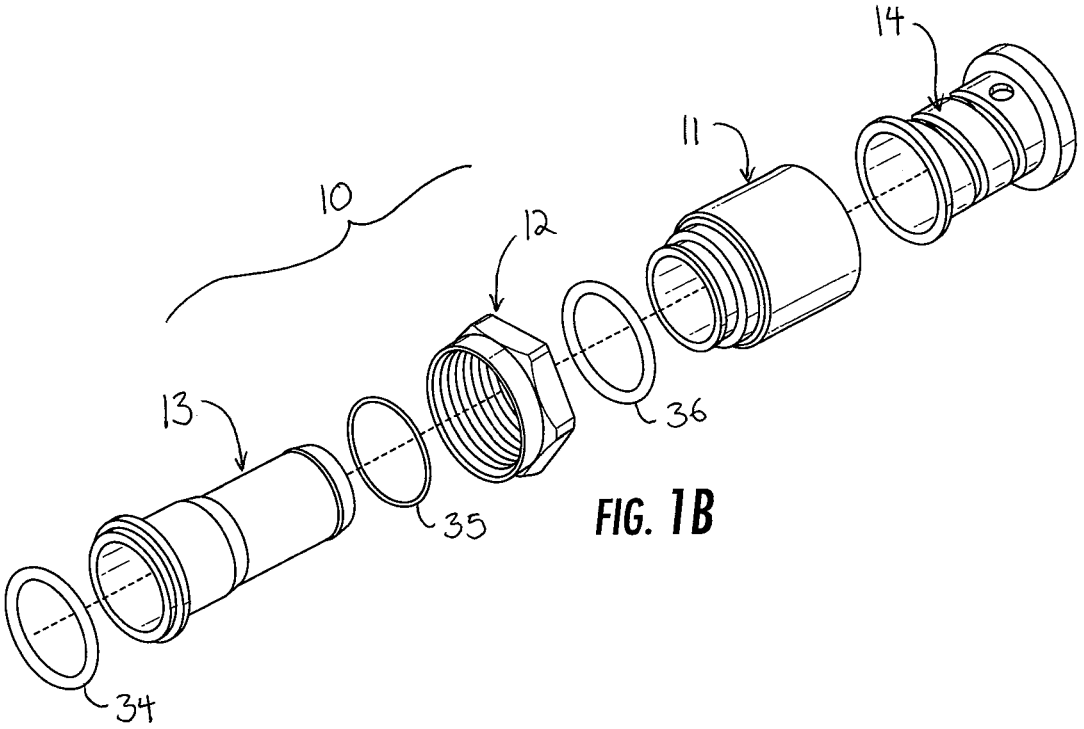

Reference now is made to the drawings, in which the same reference characters are used throughout the different figures to designate the same elements. FIGS. 1A and 1B illustrate a coaxial cable connector 10 in perspective and exploded perspective views, the connector 10 including an outer barrel 11 and a coupling nut 12 both mounted for rotation on an inner post 13 coaxially about a longitudinal axis A extending through the connector 10. The outer barrel 11 houses an inner sleeve 14 which axially compresses and expands within the outer barrel 11 to receive and secure a coaxial cable 15 applied to the connector 10.

Figure 2:
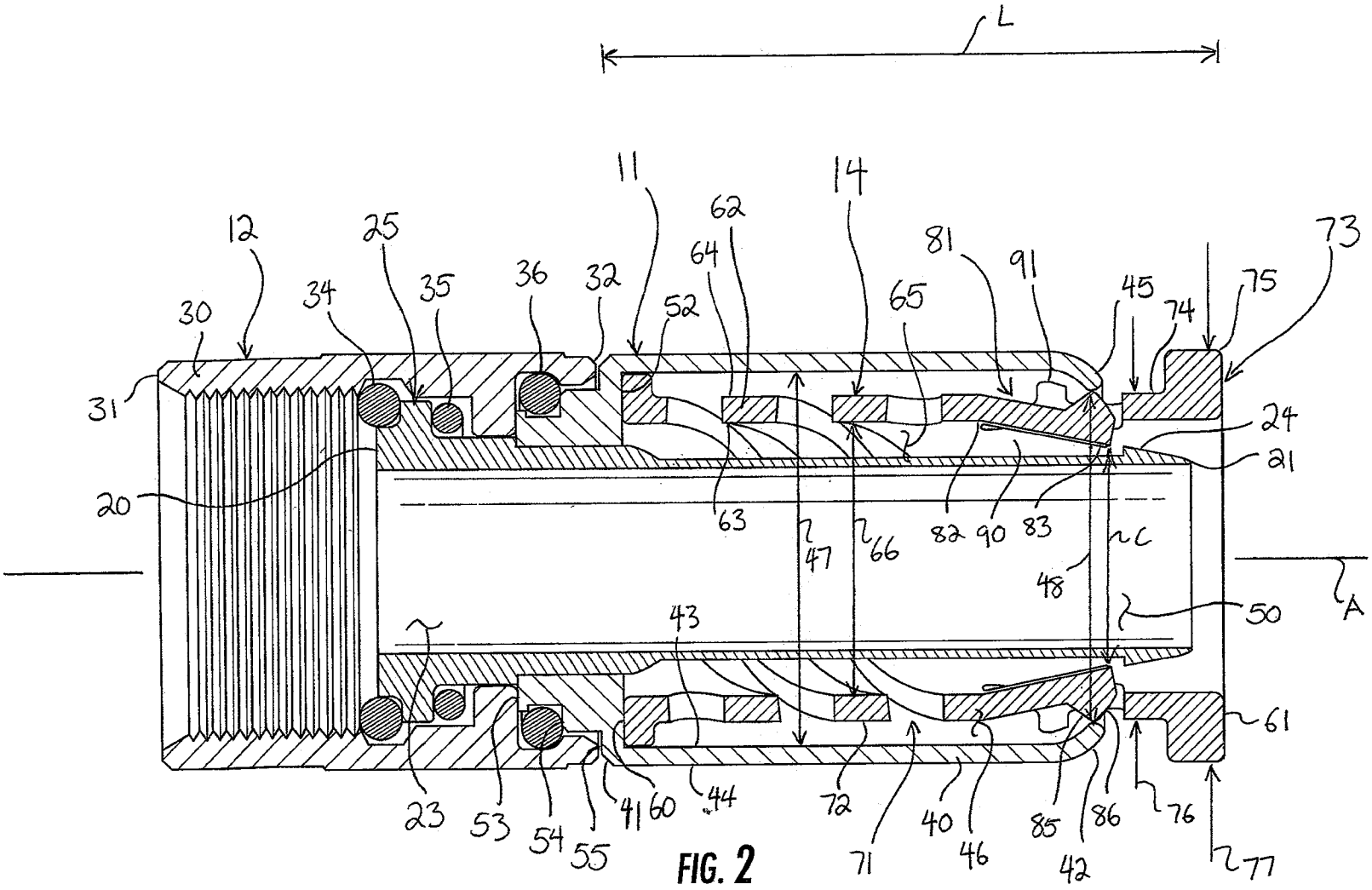
FIGS. 2 and 3 are section views of the connector of FIG. 1 taken along line 2-2 in FIG. 1A, showing the connector in uncompressed and compressed conditions, respectively.

Turning to FIG. 2, the inner post 13 is strong, rigid, and electrically conductive. It has a front end 20, an opposed rear end 21, and a cylindrical sidewall 22 extending therebetween. The rear end 21 is open, providing access to an interior bore 23 within the inner post 13. An annular barb 24 is formed integrally and monolithically in the sidewall 22 at the rear end 21 of the inner post 13. At the front end 20 of the inner post 13, a series of adjacent and axially-spaced apart flanges 25 are also formed integrally and monolithically in the sidewall 22, each flange 25 having a different outer diameter. The flanges 25 provide mounting and bearing surfaces for the outer barrel 11, the coupling nut 12, and gaskets disposed between the outer barrel 11 and the coupling nut 12.

The coupling nut 12 is mounted on the inner post 13 for rotation about the axis A. The coupling nut 12 has a generally cylindrical body 30 with a front end 31 and an opposed rear end 32. A rear portion of the coupling nut 12, toward the rear end 32, has an inwardly-directed, annular flange 33 which encircles one of the series of flanges 25 at the front end 20 of the inner post 13. The inner surface of the coupling nut 12 and the outer surface of the inner post 13 along the various flanges 25 defines two toroidal chambers, and in those chambers are two gaskets 34 and 35 which prevent moisture ingress into the connector 10 and which facilitate smooth rotation of the coupling nut 12 on the inner post 13.

In the embodiment shown in these drawings, the coupling nut 12 has a threaded inner surface at its front end 31, but in other embodiments, the inner surface could be smooth, formed with a collet, or have some other engagement feature for coupling to the female post of an electronic component via threading, push-on technique, or the like. One having ordinary skill in the art will readily appreciate that other inner posts and coupling nuts may be used in the connector 10 without substantially affecting the structure and operation of the outer barrel 11 and the inner sleeve 14, now described.

The outer barrel 11 has a generally cylindrical sidewall 40 extending between opposed front and rear ends 41 and 42. The sidewall 40 has opposed inner and outer surfaces 43 and 44, the inner surface 43 defining an inner diameter 47 of the outer barrel 11. The inner diameter 47 of the outer barrel 11 is generally constant except at the front and rear ends 41 and 42.

At the rear end 42, the sidewall 40 turns radially inwardly slightly, forming a smooth yet rigid lip 45 defining an opening 50 into an interior space 46 of the outer barrel 11 from the ear end 42. The inner surface 43 is smooth along the lip 45. The lip 45 has an axial length which is approximately equal to the radial distance to which it extends inward, toward the axis A. The lip 45 thus presents a constriction at the rear end 42 of the outer barrel 11 with respect to most of the rest of the outer barrel 11.

In front of the lip 45, the outer barrel 11 maintains is constant inner diameter 47 up to an annular flange 51 proximate the front end 41. The annular flange 51 turns radially inward, reducing to an inner diameter corresponding to the outer diameter of the inner post 13, such that the outer barrel 11 is mounted snugly on the inner post 13 at the annular flange 51. The front of the annular flange 51 has three forwardly-directed, annular faces of different dimensions. An innermost face 53 abuts the rear face of the annular flange 33 of the coupling nut 12. A middle face 54 defines a toroidal space for a third gasket 36, held between the outer barrel 11 and the coupling nut 12. An outermost face 55 extends between the middle face 54 and the outer surface 44 of the outer barrel 11. The annular flange 51 also has a rear face, defining an annular, interior end wall 52 within the interior space 46 bound by the outer barrel 11. The end wall 52 defines a front end to the interior space 46.

The outer barrel 11 encircles the inner sleeve 14. The inner sleeve 14 has an open front end 60, an open rear end 61, and a generally cylindrical sidewall 62 extending between the front and rear ends 60 and 61. The inner sleeve 14 has opposed inner and outer surfaces 63 and 64. The inner surface 63 of the inner sleeve 14 bounds and defines a bore 65 having a constant inner diameter 66 over most of its axial length between the front and rear ends 60 and 61, except as will be explained. The rear end 61 of the inner sleeve 14 projects slightly out of the rear end 42 of the outer barrel 11, ready to receive a coaxial cable and available to be grasped by the fingers to push and pull the inner sleeve 14 into and out of the outer barrel 11. The bore 65 is sized and shaped to closely receive the coaxial cable 15 when applied thereto.

Figure 3:
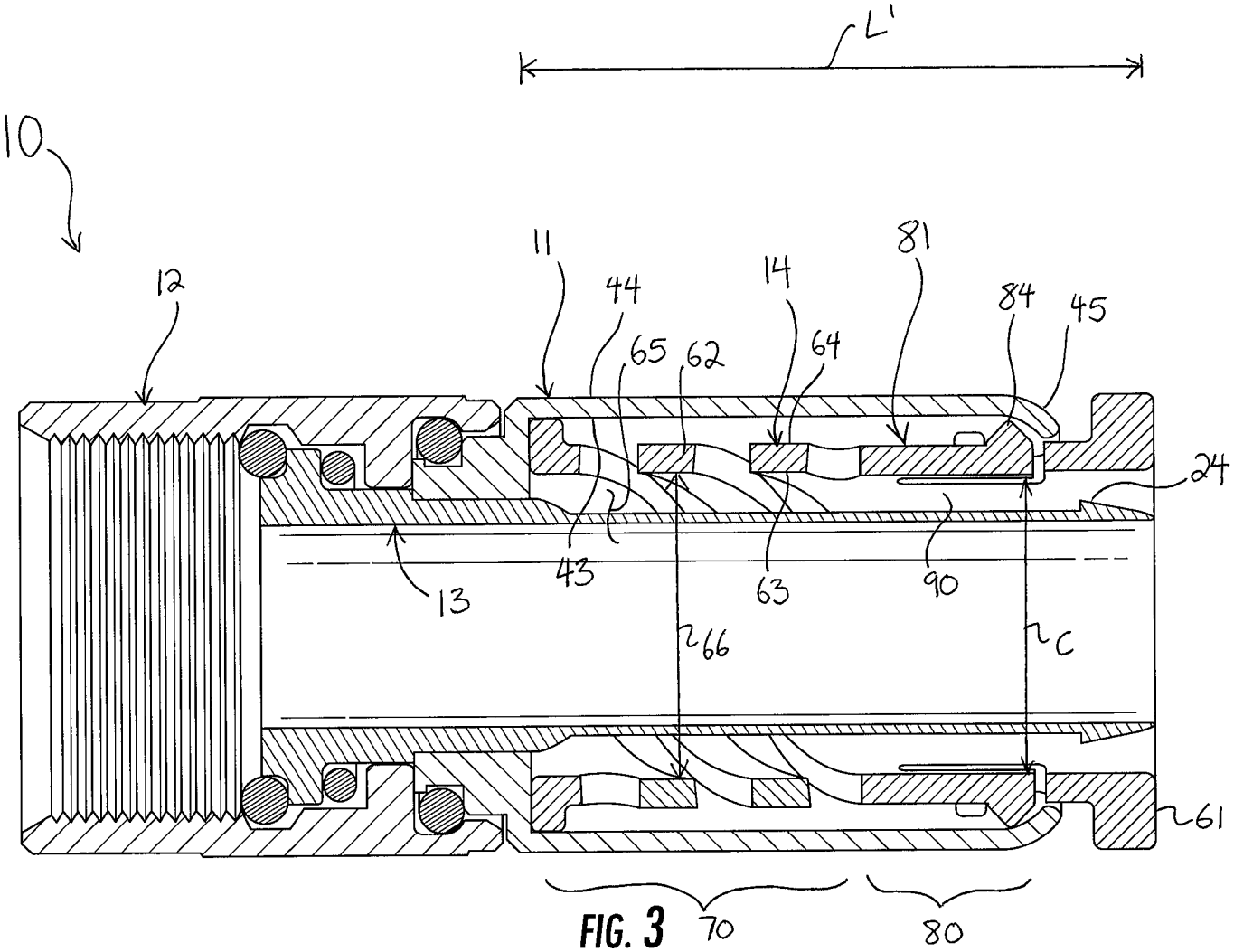

Still referring to FIG. 2, the inner sleeve 14 is integrally and monolithically formed with a compression assembly 70 in the sidewall 62, which includes a plurality of helical slots 71 formed through the sidewall 62 from the inner surface 63 to the outer surface 64. The slots 71 define diagonal structural ribs 72 of the sidewall 62. The slots 71 between the ribs 72 allow the compression assembly 70 to move between an uncompressed condition (as shown in FIG. 2) and a compressed condition (as shown in FIG. 3) of the compression assembly 70, in response to axial application of a forward force on the inner sleeve 14. The compression assembly 70 has a spring bias tending to urge the rear end 61 of the inner sleeve 14 backward out of the compressed condition, toward the rear end 42 of the outer barrel 11.

The front and rear ends 60 and 61 of the inner sleeve 14 are both continuous and unbroken by the slots 71. Each slot 71 has a forward end directed toward the front end 60 of the inner sleeve 14 and an opposed rearward end which is directed toward the rear end 61 of the inner sleeve 14 and is angularly offset with respect to the respective forward end of the respective slot 71, so that each slot 71 is aligned helically in the sidewall of the inner sleeve 14, disposed in a counter-clockwise rotational direction from the forward end to the rear end. One having reasonable skill in the art will readily appreciate that the slots 71 could be aligned in an opposite direction, namely, in a clockwise direction from the front end 31 to the rear end 32. Further, the slots 71 could have a different structure and arrangement, such as axially-spaced apart circumferential slots arranged parallel to the front and rear ends 60 and 61 of the inner sleeve 14, or some other fashion.

When the cable 15 is introduced into the bore 65 of the inner sleeve 14, the slots 71 axially collapse in response to axial compression of the inner sleeve 14 between the front and rear ends 60 and 61 thereof, with the ribs 72 moving closer together as the front and rear ends 60 and 61 move together. As the term is used this description, the term "axial" means extending or aligned parallel to the longitudinal axis A, and the term "radial" means aligned along a radius extending toward or from the longitudinal axis A. Further, other terms like "ahead of" or "before" or "I n front of" identify a relative axial direction or position, namely, more toward the front end 31 of the coupling nut 12, and similarly, terms like "behind" identify a relative axial direction or position more toward the rear end 61 of the inner sleeve 14.

At the rear end 61 of the inner sleeve 14 is a stop ring 73. The stop ring 73 is formed integrally and monolithically with the sidewall 62 of the inner sleeve 14. The stop ring 73 has a forward ring 74 and an enlarged rear ring 75 behind the forward ring 74. The forward ring 74 has a first outer diameter 76 which corresponds to the outer diameter of the inner sleeve 14. This outer diameter 76 is just less than an inner diameter 48 of the constricted lip 45 of the outer barrel 11. The rear ring 75 has a second outer diameter 77 which is larger than both the first outer diameter 76 of the forward ring 74 and the inner diameter 48 of the lip 45. As such, when the compression assembly 70 compresses axially, the enlarged rear ring 75 encounters the lip 45 and is prevented from moving past the opening 50.

An engagement assembly 80 is formed in the sidewall 62 between the compression assembly 70 and the stop ring 73. The engagement assembly 80 includes fingers 81 spaced apart by spars 90. The axially-extending fingers 81 are formed in the inner sleeve 14. The inner sleeve 14 has several fingers 81, such as preferably four, but perhaps as few as one and as many as eight or more, depending on the size and circumference of the connector 10 and cable 15. The fingers 81 are circumferentially-spaced apart about the sidewall 62. The fingers 81 are identical and only one is described here, with the understanding that the description applies to each finger 81 equally.

The finger 81 has a base 82 and a free end 83; the base 82 is formed integrally and monolithically to the sidewall 62 of the inner sleeve 14, and the finger 81 extends axially away from the base 82 to the free end 83. The finger 81 is flanked on either side and at the free end 83 by slots through the sidewall 62, such that the finger 81 cantilevers or projects outwardly from the base 82. The finger 81 is resilient and has shape memory, such that it can radially deform or be deformed and still return to a neutral position. FIG. 3 shows this neutral position of the finger 81, where the finger 81 is unbiased and aligned with the cylindrical sidewall 62 of the inner sleeve 14. FIG. 2 shows the finger 81 in a deformed position, however, where the finger 81 is deformed into the bore 65.

The finger 81 has a constant thickness along its length between the base 82 and the free end 83 but for proximate to the free end 83. At the free end 83, the finger 81 has an outwardly-extending protrusion 84 on its outer surface 64. The protrusion 84 projects radially away from the axis A, and having a front face 85, oriented radially outward and axially forward, and an opposed rear race 86, oriented radially outward and axially backward. Along most of the length of the finger 81, the outer surface 64 has an outer diameter which is less than the inner diameter 48 of the lip 45, but when the finger 81 is in the neutral position of FIG. 3, the protrusion 84 projects radially to an outer diameter which is greater than the inner diameter 48 of the lip 45. When the finger 81 is deformed, as is explained below, the protrusion 84 projects radially to an outer diameter which is just less than the inner diameter 48 of the lip 45.

The fingers 81 are circumferentially spaced apart or offset by rigid spars 90, which are slender, elongate, axially-extending portions of the sidewall 62 that do not deform radially. Thus, the spars are rigid portions of the sidewall 62 of the inner sleeve 14, defined between adjacent fingers 81. The spars 90 extend between the fingers 81 from the compression assembly 70 to the stop ring 73, connecting the compression assembly 70 to the stop ring 73. The spars 90 are also formed with upstanding, generally cube-shaped projections 91 slightly axially in front of the protrusions 84. As seen in FIG. 3, the projections 91 project radially outwardly a radial distance less than the radial distance of the protrusions 84. In other words, the outer diameter of the projections 91 is less than the outer diameter of the protrusions 84. The projections 91 do, however, projected radially outward further than the lip 45; and as such, the projections 91 abut the lip 45 to prevent retraction of the inner sleeve 14 out of the outer barrel 11 when the compression assembly 70 lengthens.

In operation, the connector 10 is useful as a connector which users can install without necessarily needing a tool such as a compression tool. The inner sleeve 14 assists in the installation of the connector 10 on a cable 15 and also prevents removal of the cable 15 from the connector 10.

The compression assembly 70 moves between a lengthened and uncompressed condition and a contracted and compressed condition. The compression assembly 70 is biased from the compressed condition to the uncompressed condition. In the uncompressed condition, shown in FIG. 2, the compression assembly 70 is axially lengthened, and so the inner sleeve 14 is axially lengthened. In FIG. 2, the inner sleeve has a length L from the front end 60 to the rear end 61. The compression assembly 70 is fully within the outer barrel 11, the stop ring 73 is fully outside the outer barrel 11, and the engagement assembly 80 is partially within and partially outside the outer barrel 11. The projection 91 is just in front of the lip 45, near where the sidewall 62 begins to turn radially inward. In this uncompressed condition of the compression assembly 70, the inner sleeve 14 is "pushed back," such that the protrusion 84 on the finger 81 is in confrontation with the lip 45 and deformed. The lip 45 is rigid, but the finger 81 is deformable, and so the constricting lip 45 causes the finger (and all fingers 81, depending on the number of fingers 81 in the embodiment) to deflect and deform radially inward; the diagonal rear face 86 of the protrusion 84 slides against the inner surface 43 of the outer barrel 11 at the lip 45 and causes the finger 81 to deform. This is defined as a deformed condition of the engagement assembly 80 and a deformed condition of the finger 81, which conditions impede axial movement of a coaxial cable 15 within the inner sleeve 14. The fingers 81 define a constricted inner diameter C, and the fingers 81 are just slightly ahead of the annular barb 24 on the inner post 13.

When the connector 10 is free of a cable and unconnected to anything, the compression assembly 70 is arranged or moved into this uncompressed condition and the engagement assembly 80 into this deformed condition. Thus, the compressed condition of the connector 10 is a neutral or relaxed condition where no force or bias is acting on it.

The user then prepares the connector 10 and a cable 15 for installation. First, the user prepares a cable 15 according to conventional means. That preparation is not described in detail here but the jacket is stripped and folded back to expose a flexible shield and dielectric encircling the center conductor, and the shield and dielectric are cut down so that the center conductor protrudes beyond them.

The user picks up the connector 10 and prepares it for application onto the cable 15. To ready the connector 10, the user grasps the outer surface 44 of the outer barrel 11 and pushes the stop ring 73 axially forward by applying an axially-forward force to the rear ring 75. This moves the connector 10 into the position shown in FIG. 3; the compression assembly 70 is moved into the compressed condition, and the engagement assembly 80 is allowed to relax, thereby moving into a neutral condition. Applying a sufficient axially-forward force on the stop ring 73 causes the compression assembly 70 to contract and compress axially, placing the compression assembly 70 under compression. The helical slots 71 narrow and the ribs 72 come axially closer together. The compression assembly 70 thus shortens in length, and the inner sleeve 14 does, too; the inner sleeve 14 shortens in length only at the compression assembly 70. In FIG. 3, the inner sleeve 14 acquires a new length L', which is shorter than the length L.

Because the compression assembly 70 is shortened, the engagement assembly 80 is axially displaced. The engagement assembly 80 moves forward slightly, and so the protrusion 84 moves forward, axially away from the lip 45. The protrusion 84 slides forward along the inner surface 43 of the lip 45 until the protrusion 84 is against that portion of the inner surface 43 which has a constant inner diameter, forward of the reduced inner diameter of the lip 45. The finger 81 thus comes out of deformation and returns to its neutral position. In the neutral position of the finger 81, the finger 81 is aligned with the sidewall 62 of the inner sleeve 14, and the inner surface 63 along the finger 81 is contiguous and parallel with the inner surface 63 along the other portions of the inner sleeve 14. The reduced inner diameter C of the finger 81 transforms into the inner diameter 66 of the bore 65. This is characterized as a neutral condition of the engagement assembly 80 and a neutral position of the finger 81, best shown in FIG. 3, which allows axial movement of a coaxial cable 15 applied within the inner sleeve 14.

When the compression assembly 70 is in the compressed condition and the engagement assembly 80 is in the neutral condition, the connector 10 is ready to receive the prepared cable 15. The finger 81 is moved well ahead of the barb 24, and the bore 65 is opened without obstruction. The user can now apply the cable 15 by inserting and moving the cable 15 forward through the open rear end 61 of the inner sleeve 14.

Figure 4:
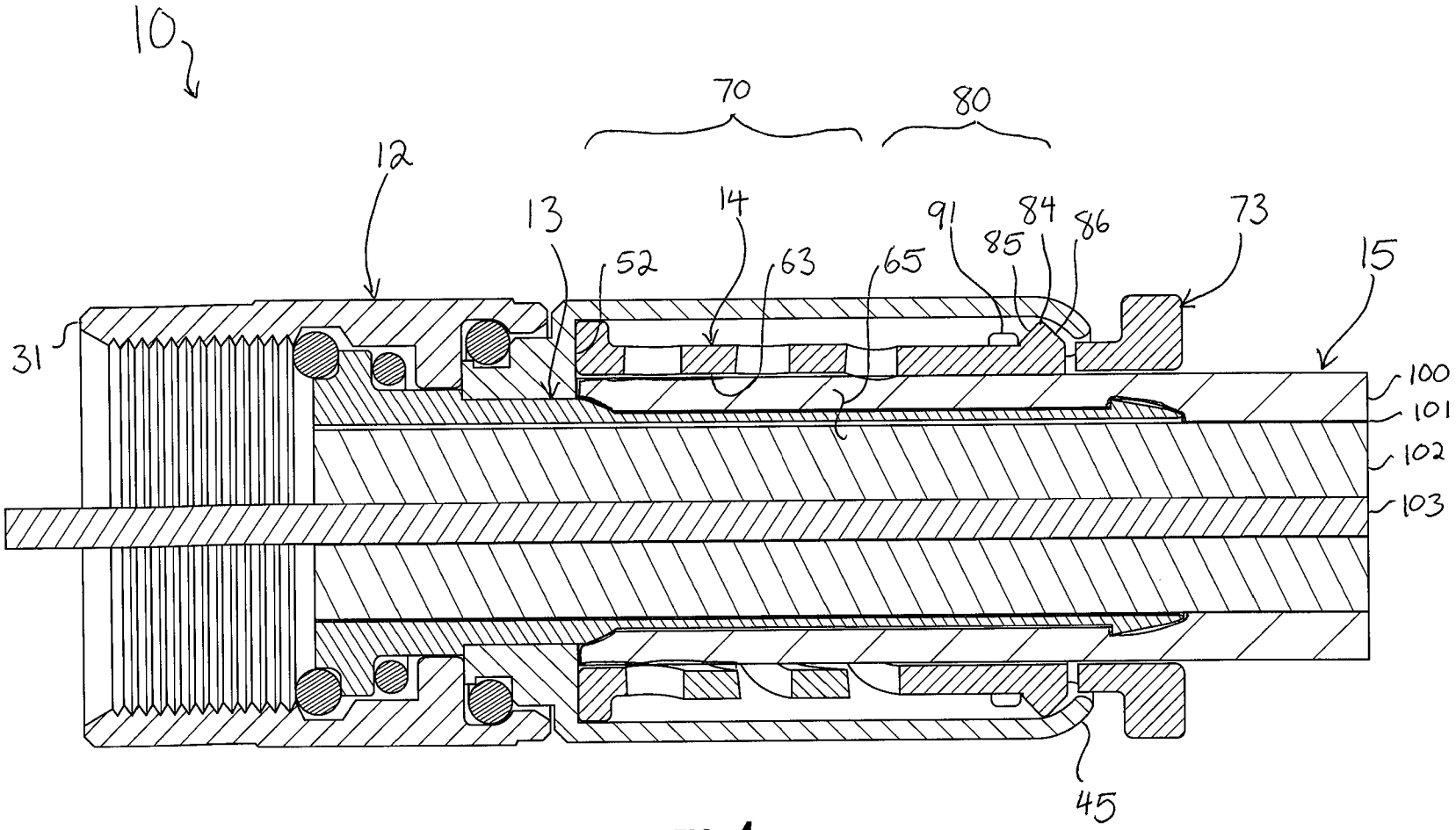
FIGS. 4, 5, and 6 are section views of the connector of FIG. 1 taken along line 2-2 in FIG. 1A, showing the connector in uncompressed and compressed conditions, respectively, with a cable applied thereto.

FIG. 4 shows a cable 15 slid forward into the connector 10. The compression assembly 70 is in the compressed condition, the inner sleeve 14 is in the compressed condition, the engagement assembly 80 is in the neutral condition, and the finger is 81 in the neutral position. The cable 15 has been prepared; its jacket 100 is folded back, and the shield 101 and dielectric 102 are cut shorter than the center conductor 103. The prepared end of the jacket 100 and the flexible shield 101 of the cable 15 are in contact against the inner surface 63 of the inner sleeve 14 and the outer surface of the inner post 13, and the prepared end of the jacket and the flexible shield are seated against the end wall 52 of the outer barrel 11 at the forward end of the bore 65. The dielectric 102 has been advanced to the front end 20 of the inner post 13, and the center conductor 103 extends beyond the front end 31 of the coupling nut 12. The user no longer needs to apply an axially-forward force against the stop ring 73, because the cable 15 is now engaged by the barb 24 on the inner post 13 and is thus slightly deformed and constricted radially outward around the barb 24, thereby creating sufficient friction between the cable 15 and the inner surface 63 of the inner sleeve 14 and the outer surface of the inner post 13 so that the cable 15 does not slide out of the connector 10 and the compression assembly 70 does not expand into the uncompressed condition. However, while in this depiction the connector 10 is applied to the cable 15, it is not yet secured on the cable 15.

Figure 5:
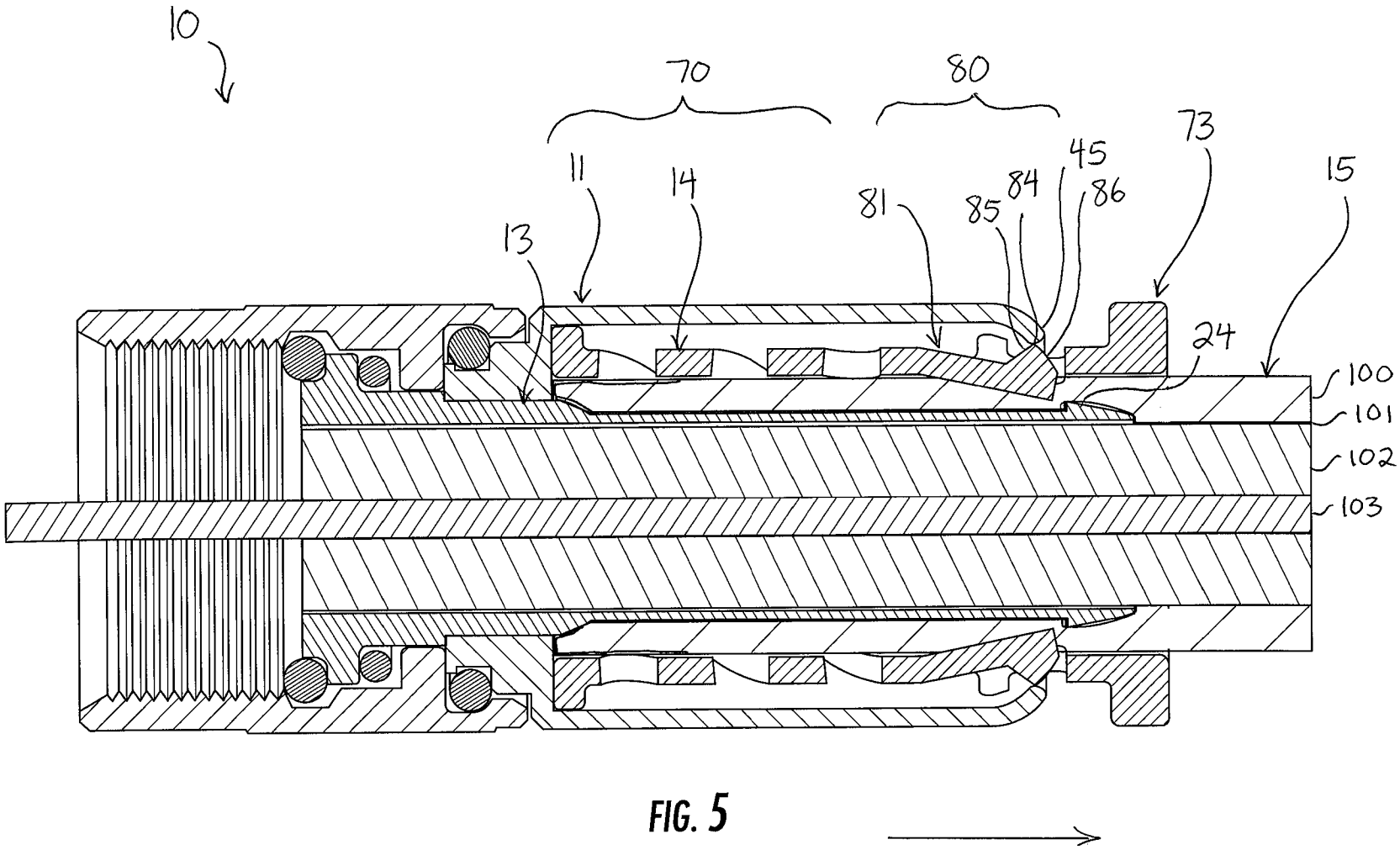

FIG. 5 shows the connector 10 secured on the cable 15. To secure the connector 10 on the cable 15, the user grasps the stop ring 73 in one hand and the outer barrel 11 and cable 15 in the other. While tightly holding the outer barrel 11 and cable 15, the user pulls back on the stop ring 73. The user may even push the cable 15 forward into the connector 10 while pulling back on the stop ring 73. By doing so, the user pulls the compression assembly 70 out of contraction, out of the compressed condition, toward the uncompressed condition, and thus moves the engagement assembly 80 backward within the inner sleeve 14. When the engagement assembly 80 is moved backward, the protrusion 84 confronts and abuts the constricted lip 45, and the rear face 86 of the protrusion 84 slides down the decreasing inner diameter of the lip 45.

The finger 81 is therefore urged into radial deformation. With the jacket 100 and shield 101 now between the inner post 13 and the inner sleeve 14, however, the finger 81 bites into the jacket 100 and shield 101. And, since the compression assembly 70 is lengthened, the finger 81 is now just in front of the barb 24, and the jacket 100 is bent, kinked, and bitten into, creating an engagement between the barb 24 and the finger 81. With the fingers 81 deformed, they acquire the reduced inner diameter C again. The cable 15 is larger than the reduced diameter C and cannot be pulled out of the bore 65, over the barb 24 and under the fingers 81—the fit is simply too tight. Now, the connector 10 is secured on the cable 15. In this deformed condition of the finger 81, the finger 81 impedes axial movement of the coaxial cable 15 within the inner sleeve 14, thereby securing the cable 15 within the connector 10. Indeed, further pulling on the cable 15 out of the connector 10 actually increases the security of the connector 10 on the cable 15, because it further causes the finger 81 to abut the lip 45, deform inwardly, and bite deeper into the jacket.

Figure 6:
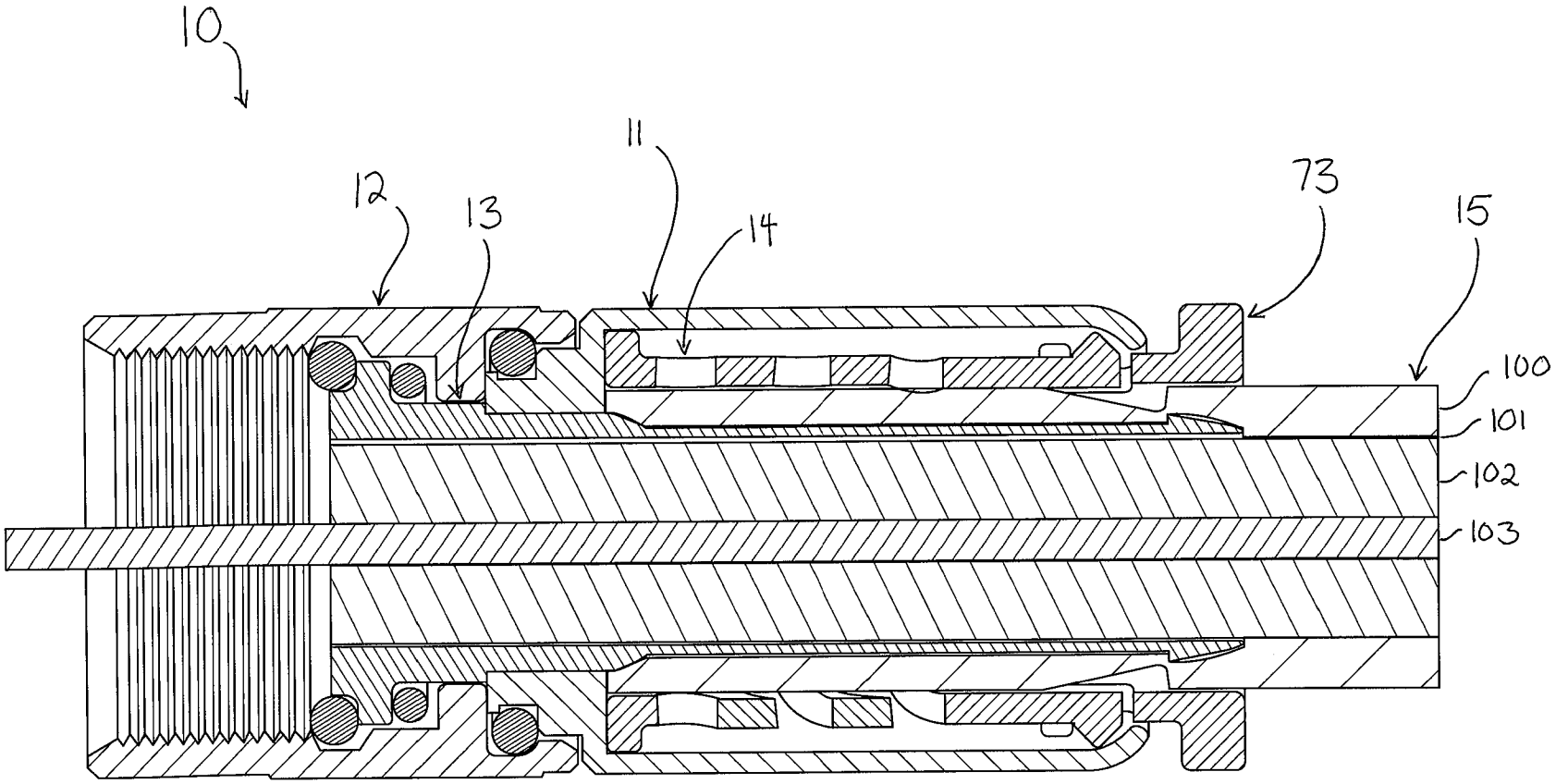

If the user does desire to remove the connector 10 from the cable 15, the user can push the stop ring 73 forward while holding the cable 15 fixed, thereby moving the compression assembly 70 into the uncompressed condition and the engagement assembly 80 into the neutral condition, as shown in FIG. 6. The finger 81 moves back to the neutral condition and out of impingement with the cable 15, thereby allowing the cable 15 to move axially within the inner sleeve 14. The cable 15 can then be pulled out the back of the connector 10.

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof. To the extent that modifications do not depart from the spirit of the invention, they are intended to be included within the scope thereof.

The invention claimed is:

1. A coaxial cable connector for engagement with a coaxial cable, the coaxial cable connector comprising:

an outer barrel having a front end, a rear end, and a rigid lip at the rear end;

an inner sleeve within the outer barrel defining a bore for receiving the coaxial cable, the inner sleeve moving between uncompressed and compressed conditions and including an engagement assembly having a finger which is formed in the inner sleeve for resilient movement between a neutral position in which the finger is out of the bore, and a deformed position in which the finger is deformed into the bore, wherein the inner sleeve further is formed with a compression assembly allowing the inner sleeve to axially compress and expand between the compressed and uncompressed conditions;

the finger includes a base formed to the inner sleeve and a free end extending axially away from the base in a first direction; and axial movement of the inner sleeve with respect to the outer barrel from the compressed condition to the uncompressed condition along the first direction imparts movement to the finger from the neutral position to the deformed position.

2. The coaxial cable connector of claim 1, wherein the inner sleeve is formed with a stop ring which limits axial movement of the inner sleeve into the outer barrel.

3. The coaxial cable connector of claim 2, wherein:

the stop ring has a forward ring with a first diameter which is less than an inner diameter of the rigid lip; and the stop ring has a rear ring with a second diameter which is greater than the inner diameter of the rigid lip.

4. The coaxial cable connector of claim 1, wherein the compression assembly includes slots formed in the inner sleeve allowing the inner sleeve to compress and expand.

5. The coaxial cable connector of claim 4, wherein the slots in the compression assembly are spaced apart circumferentially and radially.

6. The coaxial cable connector of claim 1, wherein:

the finger is formed with an outwardly-extending protrusion; and during movement of the inner sleeve from the compressed condition to the uncompressed condition thereof, the protrusion abuts the rigid lip of the outer barrel, and the rigid lip imparts movement of the finger from the neutral position to the deformed position thereof.

7. The coaxial cable connector of claim 6, wherein:

the protrusion has a front face and an opposed rear face;

the front face is directed radially outward and axially forward; and the rear face is directed radially outward and axially backward.

8. The coaxial cable connector of claim 1, further comprising a spar circumferentially offset from the finger, wherein the spar is rigid and includes a projection which abuts the rigid lip to prevent retraction of the inner sleeve out of the outer barrel.

9. The coaxial cable connector of claim 8, wherein the spar has an outer diameter which is greater than the inner diameter of the rigid lip.

10. A coaxial cable connector for engagement with a coaxial cable, the coaxial cable connector comprising:

an outer barrel having a front end, a rear end, and a rigid lip at the rear end;

an inner sleeve within the outer barrel, the inner sleeve including an engagement assembly which is arrangeable between a neutral condition and a deformed condition, wherein the neutral condition allows axial movement of the coaxial cable within the inner sleeve and the deformed condition impedes axial movement of the coaxial cable within the inner sleeve;

the engagement assembly includes a finger, with an outwardly-extending protrusion, which finger is formed in the inner sleeve for resilient movement between a neutral position in which the finger allows axial movement of the coaxial cable within the inner sleeve, and a deformed position in which the finger impedes axial movement of the coaxial cable within the inner sleeve;

the engagement assembly further includes a spar circumferentially offset from the finger, and the spar is rigid and includes a projection which abuts the rigid lip to prevent retraction of the inner sleeve out of the outer barrel; and axial movement of the inner sleeve imparts arrangement of the engagement assembly of the inner sleeve between the neutral and deformed conditions, and when the inner sleeve is moved axially rearward, the finger moves from the neutral position to the deformed position, thereby imparting movement of the coaxial cable within the inner sleeve.

11. A coaxial cable connector for engagement with a coaxial cable, the coaxial cable connector comprising:

an outer barrel having a front end, a rear end, and a rigid lip at the rear end;

an inner sleeve within the outer barrel defining a bore for receiving the coaxial cable, the inner sleeve including a finger formed therein for resilient movement between a neutral position in which the finger is out of the bore and allows axial movement of the coaxial cable through the bore, and a deformed position in which the finger is deformed into the bore and impedes axial movement of the coaxial cable through the bore, wherein the inner sleeve further is formed with a compression assembly allowing the inner sleeve to axially compress and expand between compressed and uncompressed conditions; and axial movement of the inner sleeve between the compressed condition and the uncompressed condition imparts radial movement of the finger between the neutral positon and the deformed position.

12. The coaxial cable connector of claim 11, wherein the inner sleeve is formed with a stop ring which limits axial movement of the inner sleeve into the outer barrel.

13. The coaxial cable connector of claim 12, wherein:

the stop ring has a forward ring with a first diameter which is less than an inner diameter of the rigid lip; and the stop ring has a rear ring with a second diameter which is greater than the inner diameter of the rigid lip.

14. The coaxial cable connector of claim 11, wherein the compression assembly includes slots formed in the inner sleeve allowing the inner sleeve to compress and expand.

15. The coaxial cable connector of claim 14, wherein the slots in the compression assembly are spaced apart circumferentially and radially.

16. The coaxial cable connector of claim 11, wherein:

the finger is formed with an outwardly-extending protrusion; and during axial movement of the inner sleeve from the compressed condition to the uncompressed condition, the protrusion abuts the rigid lip of the outer barrel, and the rigid lip imparts movement of the finger from the neutral position to the deformed position thereof.

17. The coaxial cable connector of claim 16, wherein:

the protrusion has a front face and an opposed rear face;

the front face is directed radially outward and axially forward; and the rear face is directed radially outward and axially backward.

18. The coaxial cable connector of claim 11, further comprising a spar circumferentially offset from the finger, wherein the spar is rigid and includes a projection which abuts the rigid lip to prevent retraction of the inner sleeve out of the outer barrel.

19. The coaxial cable connector of claim 18, wherein the spar has an outer diameter which is greater than the inner diameter of the rigid lip.

* * * * *